US009263024B2

(12) United States Patent
Theiler

(10) Patent No.: US 9,263,024 B2
(45) Date of Patent: Feb. 16, 2016

(54) CIRCUIT ARRANGEMENT AND METHOD FOR ACTIVE NOISE CANCELLATION

(75) Inventor: Helmut Theiler, Lieboch (AT)

(73) Assignee: ams AG, Unterpremstatten (AT)

( * ) Notice: Subject to any disclaimer, the term of this patent is extended or adjusted under 35 U.S.C. 154(b) by 332 days.

(21) Appl. No.: 13/988,013

(22) PCT Filed: Nov. 9, 2011

(86) PCT No.: PCT/EP2011/069747
§ 371 (c)(1),
(2), (4) Date: Jul. 30, 2013

(87) PCT Pub. No.: WO2012/072391
PCT Pub. Date: Jun. 7, 2012

(65) Prior Publication Data

US 2013/0329901 A1 Dec. 12, 2013

(30) Foreign Application Priority Data

Nov. 29, 2010 (DE) ..... 10 2010 052 833

(51) Int. Cl.
*G10K 11/178* (2006.01)

(52) U.S. Cl.
CPC ..... *G10K 11/178* (2013.01); *G10K 11/1782* (2013.01); *G10K 2210/1053* (2013.01); *G10K 2210/3027* (2013.01)

(58) Field of Classification Search
None
See application file for complete search history.

(56) References Cited

U.S. PATENT DOCUMENTS

| | | | | |
|---|---|---|---|---|
| 7,489,785 | B2 * | 2/2009 | Donaldson et al. | 381/71.6 |
| 7,873,173 | B2 | 1/2011 | Inoue et al. | |
| 2009/0147982 | A1 | 6/2009 | Ashida et al. | |

(Continued)

FOREIGN PATENT DOCUMENTS

| | | | |
|---|---|---|---|
| CN | 1223738 | A | 7/1999 |
| CN | 101211558 | A | 7/2008 |

(Continued)

OTHER PUBLICATIONS

Wikipedia: "Differential Signaling", Version of Nov. 20, 2010, download: Jul. 11, 2011, <URL:http://en.wikipedia.org/w/index.php?title=Differential_signaling&oldid=397857520>, pp. 1-3.
Wikipedia: "Electronic mixer", Version of Aug. 13, 2010, download: Jul. 7, 2011, <URL:http://en.wikipedia.org/w/index.php?title=Electronic_mixer&oldid=378761934>, pp. 1-2.

(Continued)

*Primary Examiner* — Brenda Bernardi
(74) *Attorney, Agent, or Firm* — McDermott Will & Emery LLP

(57) ABSTRACT

In an embodiment, a circuit arrangement for active noise cancellation, comprises a first input (E1) for supplying a playback signal (Spb), a second input (E2) for supplying a sensor signal (Sanc), a first and a second terminal (A1, A2) of an output that is designed for being connected to a loudspeaker (Lsp) and a compensating device for respectively generating a first and a second noise signal (Sanc1, Sanc2) as a function of the sensor signal (Sanc), wherein the first and the second input (E1, E2) are coupled to the first and the second terminal of the output (A1, A2) by means of the compensating device (Komp) in such a way that a virtual playback signal (Ssp1) is provided at the first terminal (A1) of the output (A1, A2) and a superposition signal (Ssp2) is provided at the second terminal (A2) of the output (A1, A2) such that a differential signal between the virtual playback signal (Ssp1) and the superposition signal (Ssp2) can be fed to the loudspeaker.

14 Claims, 4 Drawing Sheets

(56) References Cited

U.S. PATENT DOCUMENTS

Figure 1:
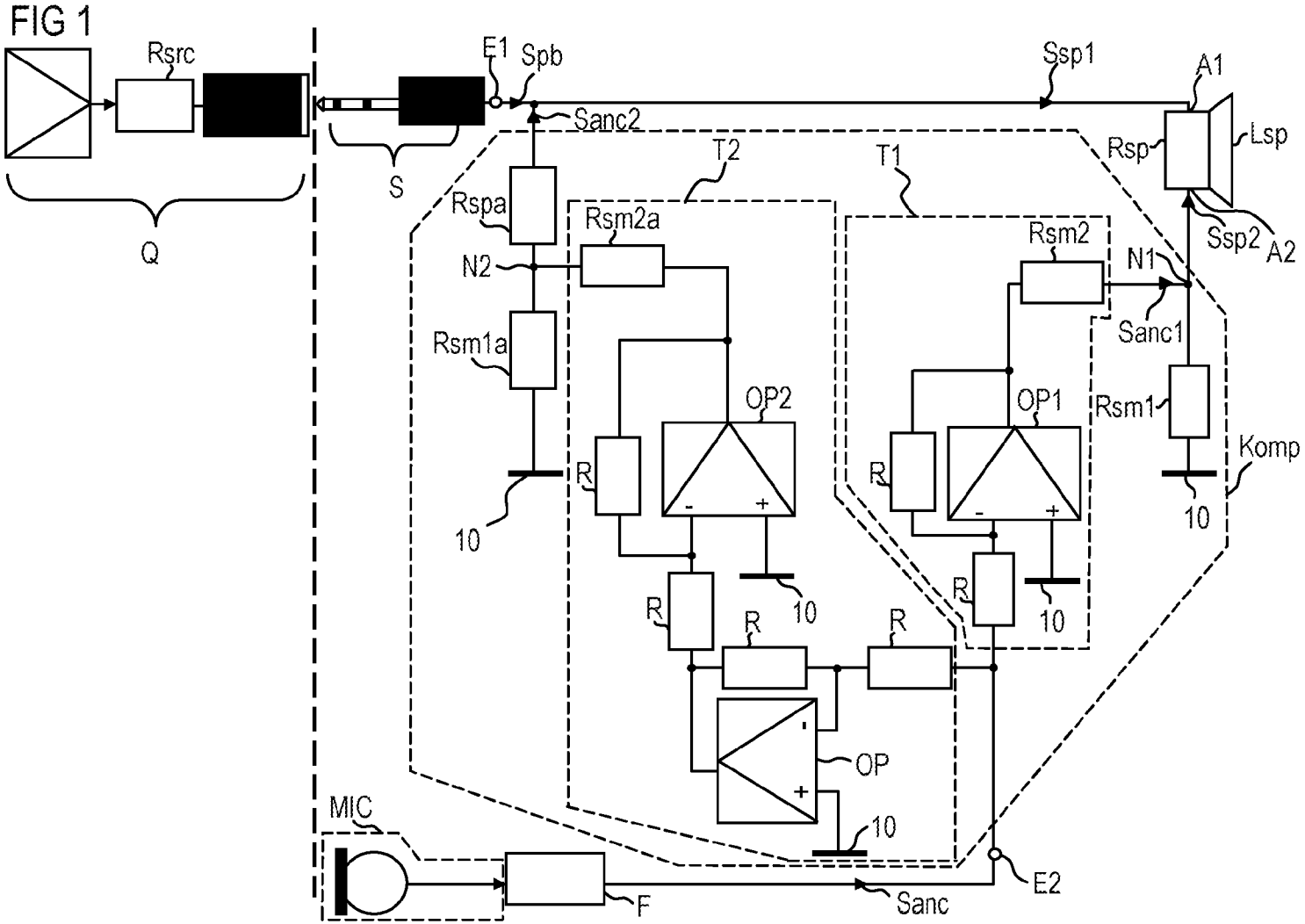

2009/0285408 A1* 11/2009 Kimura ..... 381/71.6
2012/0099736 A1* 4/2012 Rashid et al. ..... 381/71.6

FOREIGN PATENT DOCUMENTS

DE 10 2005 043 361 B4 3/2006
EP 2 131 354 A2 12/2009

OTHER PUBLICATIONS

Wikipedia: "Operationsverstärker" (translation), Version of Nov. 16, 2010, download: Jul. 7, 2011, <URL:http://de.wikipedia.org.w/index.php?title=Operationsverst%C3%A4rker&oldid=81566413>, pp. 1-19.

* cited by examiner

Rsrc
Q
S
E1
Spb
Sanc2
Ssp1
A1
Rsp
Lsp
Ssp2
A2
Komp
N1
Sanc1
Rsm1
10
Rsm2
OP1
R
T1
T2
Rsm2a
OP2
Rspa
N2
Rsm1a
OP
E2
Sanc
F
MIC Rsrc
Q
S
E1
Spb
Sanc2
Ssp1
A1
Rsp
Lsp
Ssp2
A2
Komp
N1
Sanc1
Rsm1
10
Rsm2
OP1
T1
R
Rin1
Rin2
Sin
T2
OP2
Rspa=K·Rsp
Rsm2a=K·Rsm2
N2
Rsm1a=
K·Rsm1
R/K
OP
E2
Sanc
F
MIC Rsrc
Q
S
E1
Spb
Sanc2
Ssp1
Rspa=K·Rsp
T2
Rsm2a=
K·Rsm2
Rsm1a=
K·Rsm1
N2
Rin1
Rin2
OP'
Sin
OP2
T1
Rsm2
OP1
R
R/K
OP
10
Rsp
A1
Lsp
Ssp2
A2
N1
Sanc1
Rsm1
Komp
E2
Sanc
F
MIC

CIRCUIT ARRANGEMENT AND METHOD FOR ACTIVE NOISE CANCELLATION

The invention pertains to a circuit arrangement and a method for active noise cancellation.

Active noise cancellation is also referred to as active noise reduction and is used, for example, in headphones, earphones or telephones in order to suppress undesirable and annoying ambient noises and to reproduce the useful sound in a more intelligible fashion. This is achieved by measuring the ambient noise with an installed microphone. In order to cancel out this ambient noise, an inverse signal thereof is generated and added to the useful sound. At the ear of the user, the ambient noise therefore is acoustically canceled out.

In such active noise cancellation systems, the useful signal and the signal of the microphone processed for canceling out the ambient noise are summed at one point of the circuit. In this respect, one distinguishes between two options, namely an active summation and a passive summation. In an active summation, an active element such as, for example, an operational amplifier is additionally provided along the path of the thusly obtained summation signal to the loudspeaker. This is not the case in the passive method.

The present invention is based on passive summation and starts out from a circuit in which the summation signal is fed to a terminal of a loudspeaker, the other terminal of which refers to a reference potential terminal. A compensation signal is generated from the noise signal of the microphone by means of an inverting amplifier. This compensation signal and the useful signal are summed and the summation signal is fed to the loudspeaker. In the described known circuit, no additional switch is required for deactivating the active noise cancelling. In addition, no gap is created in the signal due to activating and deactivating the active noise cancelling. The energy consumption is optimized due to the fact that the useful signal is not fed to the loudspeaker via an active element. However, the calibration of the active noise reduction is complicated because it is influenced by the impedance of the source of the useful signal.

An objective therefore can be seen in disclosing a circuit arrangement and a method for active noise cancellation that in comparison have enhanced properties, for example, with respect to the sensitivity to the impedance of the source of the useful signal.

This objective is attained with the subject matter of the independent claims. Enhancements and embodiments respectively form the subject matter of the dependent claims.

In one embodiment, a circuit arrangement for active noise cancellation features a first input for supplying a playback signal, a second input for supplying a sensor signal, a first and a second terminal of an output that is designed for being connected to a loudspeaker and a compensating device. The compensating device is configured for respectively generating a first and a second noise signal in dependence on the sensor signal. The first and the second input are coupled to the first and the second terminal of the output by means of the compensating device in such a way that a virtual playback signal is provided at the first terminal of the output and a superposition signal is provided at the second terminal of the output such that a differential signal between the virtual playback signal and the superposition signal can be fed to the loudspeaker.

The playback signal and the sensor signal are fed to the circuit arrangement. The compensating device generates the first and the second noise signal from the sensor signal. Due to the compensating device and its coupling to the inputs and the terminals of the output of the circuit arrangement, the differential signal between the virtual playback signal and the superposition signal is fed to the connectable loudspeaker.

Due to the compensating device and its coupling to the inputs and the output of the circuit arrangement, ambient noises in space are on the one hand suppressed upstream of the loudspeaker. On the other hand, the influence of an impedance of the audio source of the playback signal on the circuit arrangement is reduced. This clearly lowers the sensitivity to an impedance at the first input of the circuit arrangement.

The playback signal is made available by an audio source such as, for example, an audio player. It therefore represents the useful signal. The sensor signal is recorded by a microphone and corresponds to the ambient noises that are canceled out upstream of the loudspeaker by means of the active noise cancellation.

In another embodiment, a virtual zero point referred to the sensor signal is formed at the first terminal of the output that is coupled to the first input of the circuit arrangement.

The first terminal of the output therefore is not modulated by the sensor signal. Since the currents of the first and the second noise signal cancel out one another at this circuit node, a virtual zero point with respect to the sensor signal is formed.

Due to this measure, the influence of an impedance of the source of the playback signal advantageously does not affect the noise cancellation.

The second noise signal is made available by the compensating device in such a way that a virtual zero point referred to the sensor signal is formed at a summation point of the passive summation of the reproduction signal and the first and the second noise signal by means of the loudspeaker, i.e., at the first terminal of the output of the circuit arrangement.

A virtual zero point corresponds to a connection to a reference potential terminal without a reference potential terminal actually being present in this case.

In an enhancement, a portion of the second noise signal that is relevant to the sensor signal is with respect to its value adapted to a portion of the superposition signal that is relevant to the sensor signal and phase-inverted relative thereto.

With respect to its value, the current portion of the second noise signal contributed by the sensor signal corresponds in its value to the current portion of the superposition signal contributed by the sensor signal, but is inverted relative thereto. The currents of the second noise signal and of the superposition signal therefore compensate one another at the first terminal of the output of the circuit arrangement. Only the voltage portion of the virtual playback signal remains at this output.

In another embodiment, the virtual reproduction signal is made available in dependence on the second noise signal and the playback signal. The superposition signal is made available in dependence on the first noise signal and the playback signal.

The difference between the virtual playback signal and the superposition signal is fed to the loudspeaker that can be connected to the output of the circuit arrangement. Consequently, a signal that was respectively generated from the superposition of the playback signal with a noise signal or an inverted noise signal is fed to each terminal of the loudspeaker.

This advantageously contributes to further increasing the insensitivity to an impedance of the audio source.

In an enhancement, the compensating device features a first and a second driver stage. An input of the first driver stage is coupled to the second input of the circuit arrangement. A first summation node, at which the first noise signal is made available, is formed at the output of the first driver stage. An input of the second driver stage is coupled to the second input of the circuit arrangement. A second summation node, at which the second noise signal is made available, is formed at the output of the second driver stage. The first summation node is coupled to the second terminal of the output of the circuit arrangement. The second summation node is coupled to the first terminal of the output of the circuit arrangement.

In an enhancement, the first driver stage features an inverting amplifier that is connected to its input and a first summation resistor that is arranged downstream of said amplifier and is connected to the first summation node. The second driver stage features a serial circuit that is connected to the input of the second driver stage and comprises two inverting amplifiers and a second summation resistor that is arranged downstream of said amplifiers and is coupled to the second summation node. The first and the second summation resistors are adapted to one another.

The driver stages are designed in such a way that the sensor signal is inverted by one driver stage while the sensor signal is not inverted by the other driver stage due to the double inversion.

In another embodiment, a first scaling resistor referred to a reference potential terminal is connected to the first summation node in order to form a first voltage divider with a resistance of the connectable loudspeaker. A second voltage divider featuring a second scaling resistor referred to the reference potential terminal, as well as a coupling resistor connected to the first input of the circuit arrangement, is connected to the second summation node.

In an enhancement, the first and the second voltage divider are scaled identically.

A signal at the second summation resistor is inverted with respect to signal at the first summation resistor. Since the first scaling resistor is adapted to the second scaling resistor and the coupling resistance is adapted to the resistance of the loudspeaker, identical conditions result regarding the first and second noise signals provided.

In an alternative embodiment, the second voltage divider and the second summation resistor respectively are scaled larger than the first summation resistor and the first voltage divider by a factor K. In this case, the sensor signal fed to the second driver stage is amplified by the factor K.

In order to maintain a compensation of the currents of the first and the second noise signal, the sensor signal is amplified by the factor K in this case by adapting the circuit of the inverting amplifier of the first driver stage. Due to this measure, the portion of the current in the second noise signal is significantly smaller than the current supplied by the playback signal. The input impedance of the circuit arrangement is thusly optimized. Consequently, identical conditions advantageously result for an audio source when the noise reduction is activated and when the noise reduction is deactivated.

The input impedance of the circuit arrangement results from the parallel connection of the first and the second voltage divider. The first voltage divider has an impedance that exceeds the resistance of the loudspeaker by the scaling resistor. The factor K is preferably scaled such that the increased impedance of the first voltage divider caused by the scaling resistor is compensated due to the parallel connection of the second voltage divider. Consequently, this results in an input impedance that is adapted to the impedance of the loudspeaker.

In an enhancement, the circuit arrangement features an adaptation unit that is coupled to the first input of the circuit arrangement that receives the virtual playback signal and is designed for making available a common-mode signal. With respect to the level control of the inverting amplifiers of the first and the second driver stage, the common-mode signal is realized in such a way that an output signal of a respective inverting amplifier is with respect to the voltage adapted to a respective signal at the first or second summation node.

The common-mode signal is made available in such a way that the output signal of the inverting amplifier of the first driver stage is with respect to the voltage adapted to the signal at the first summation node. The common-mode signal is furthermore made available in such a way that the output signal of the inverting amplifier of the second driver stage that is connected to the output of the second driver stage is with respect to the voltage adapted to the signal at the second summation node.

Due to this advantageous measure, no voltage drop occurs at the first and at the second summation resistor and no current flow caused by the virtual playback signal therefore occurs at the output of the inverting amplifiers of the first and the second driver stage. This significantly reduces the power consumption of the circuit arrangement.

In this context, adapted with respect to the voltage means that the respective signals correspond with respect to value and phase.

In another embodiment, the common-mode signal is respectively fed to a non-inverting input of the inverting amplifier of the first driver stage and a non-inverting input of the inverting amplifier of the second driver stage that is coupled to the output of the second driver stage.

In another embodiment, the adaptation unit features a third voltage divider, which is referenced to the reference potential terminal. The third voltage divider is adapted in its scaling to the first voltage divider in consideration of an amplification factor of the first and/or second driver stage.

In this case, the common-mode signal represents a version of the virtual playback signal that is divided by the amplification factor of the first and/or second driver stage. Due to this measure, signals that are identical with respect to their value, namely the first and the second noise signal, are made available at the output of the inverting amplifiers of the first and the second driver stage to the inputs of which the common-mode signal is respectively fed. Consequently, no voltage drop occurs at the first and at the second summation resistor and a leakage current caused by the virtual playback signal is prevented at the output of these inverting amplifiers.

In addition, an identical playback level is advantageously provided in this way when the driver stages are activated and deactivated.

In one embodiment, a method for active noise cancellation features the following steps:

- supplying a playback signal,
- supplying a sensor signal,
- respectively generating a first and a second noise signal in dependence on the sensor signal,
- generating a virtual playback signal in dependence on the second noise signal and the playback signal,
- generating a superposition signal in dependence on the first noise signal and the playback signal, and
- making available a differential signal between the virtual playback signal and the superposition signal for a loudspeaker.

A resistance of the source of the playback signal has no influence on the noise cancellation due to the fact that each of the two terminals of the loudspeaker is supplied with a superimposed signal, namely the virtual playback signal on the one hand and the superposition signal on the other hand, wherein each of these signals is respectively generated by means of a passive summation of the playback signal with a first or a second noise signal.

The circuit arrangement and the method are suitable for use in feed forward and feedback systems for active noise cancellation. In stereo systems, a circuit arrangement of the above-described type needs to be provided for each channel.

Figure 2:
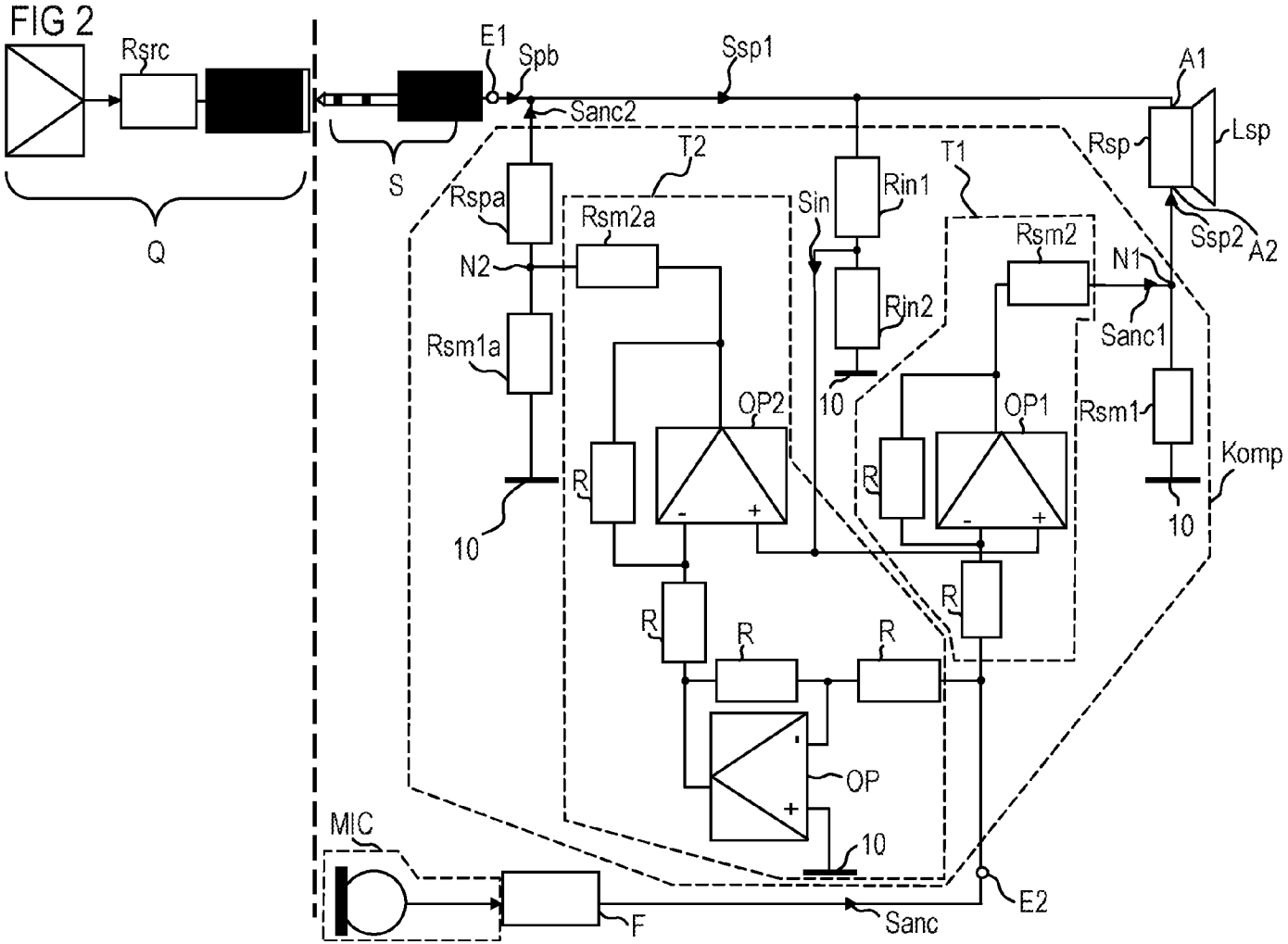
Figure 3:
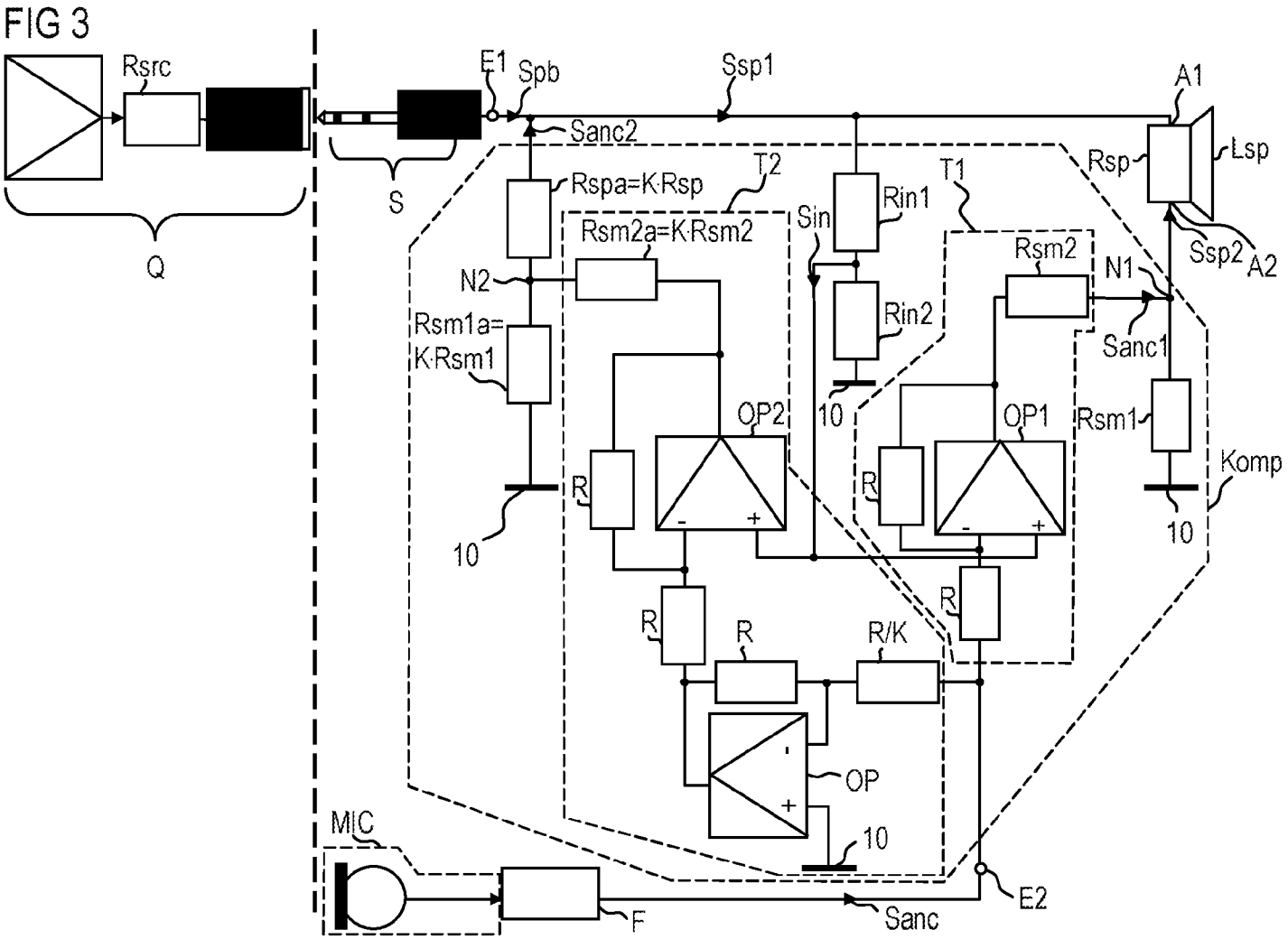
Figure 4:
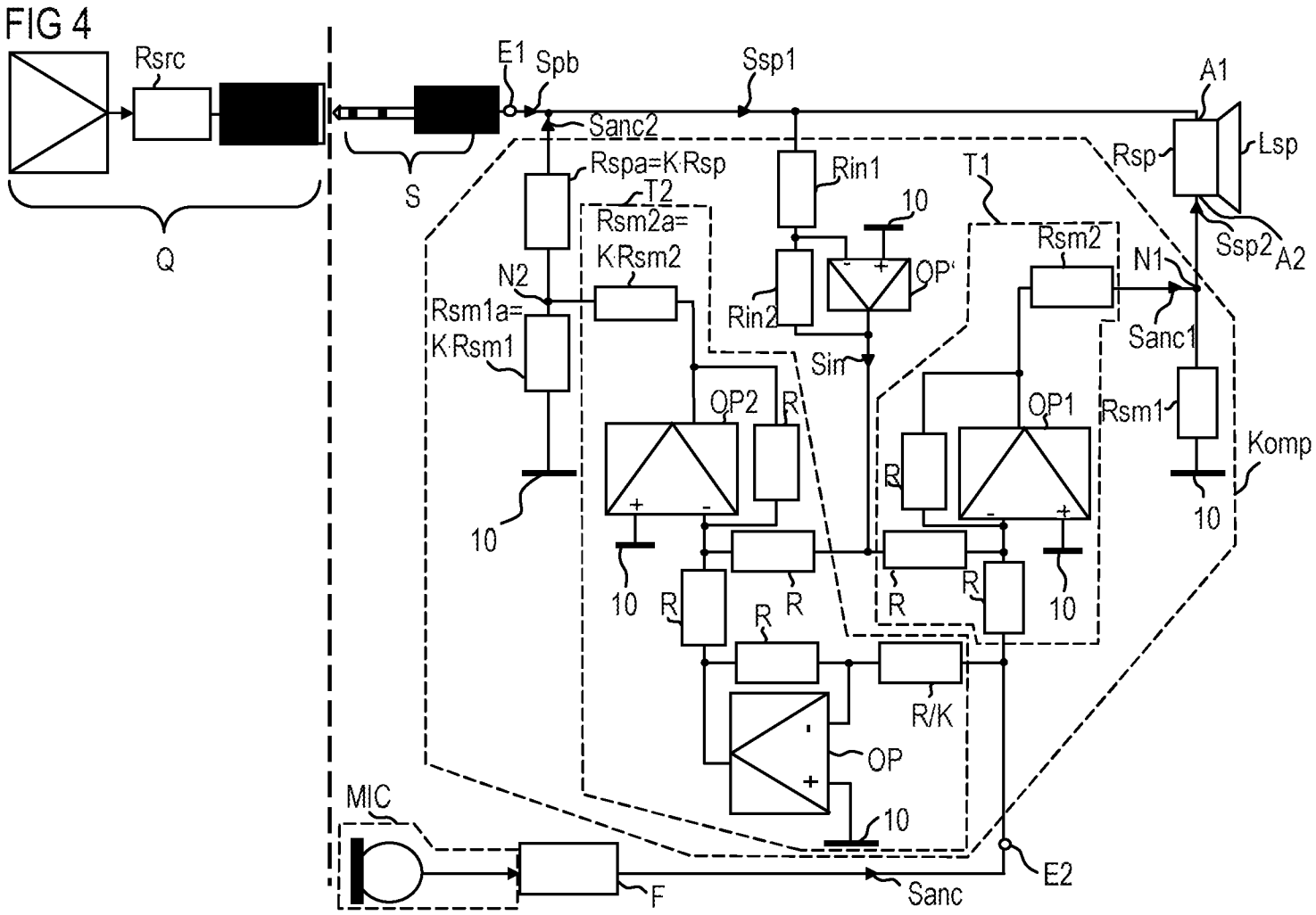

Several exemplary embodiments of the invention are described in greater detail below with reference to the figures. Identically operating or functioning components and circuit elements are identified by the same reference signs. The description of components that correspond with respect to their function is not repeated with reference to each of the individual figures. In these figures:

FIG. 1 shows a first exemplary embodiment of a circuit arrangement according to the proposed principle, FIG. 2 shows a second exemplary embodiment of a circuit arrangement according to the proposed principle, FIG. 3 shows a third exemplary embodiment of a circuit arrangement according to the proposed principle, and FIG. 4 shows a fourth exemplary embodiment of a circuit arrangement according to the proposed principle.

FIG. 1 shows a first exemplary embodiment of a circuit arrangement according to the proposed principle. The circuit arrangement comprises a first input E1, a second input E2, an output with two terminals A1, A2 for a loudspeaker Lsp and a compensating device Komp. A playback signal Spb is fed to the first input E1. A sensor signal Sanc is fed to the second input E2. A virtual playback signal Ssp1 is made available at the first terminal A1 of the output. A superposition signal Ssp2 is made available at the second terminal A2 of the output.

The compensating unit Komp features a first driver stage T1 and a second driver stage T2. The first driver stage T1 features an inverting amplifier OP1. An inverting input of the inverting amplifier OP1 is coupled to the second input E2 of the circuit arrangement. The non-inverting input of the inverting amplifier OP1 is connected to a reference potential terminal 10. A first summation resistor Rsm2 is connected to the output of the inverting amplifier OP1. This summation resistor is connected to a first summation node N1 with its other terminal. The summation node N1 is coupled to the reference potential terminal 10 via a first scaling resistor Rsm1. Furthermore, the first summation node N1 is coupled to the second terminal A2 of the output of the circuit arrangement. The second driver stage T2 comprises a series circuit featuring two inverting amplifiers OP, OP2. The inverting input of the inverting amplifier OP is coupled to the second input E2 of the circuit arrangement. An inverting input of the inverting amplifier OP2 is coupled to the output of the inverting amplifier OP. The non-inverting inputs of the inverting amplifiers OP, OP2 are respectively connected to the reference potential terminal 10. An output of the inverting amplifier OP2 is connected to a second summation node N2 via a second summation resistor Rsm2*a*. The second summation node N2 is on the one hand coupled to the reference potential terminal 10 via a second scaling resistor Rsm1*a*. On the other hand, the second summation node N2 is connected to the first input E1 of the circuit arrangement via a coupling resistor Rspa.

A resistor Rsp is provided between the first and the second terminal A1, A2 of the output of the circuit arrangement. This resistor corresponds to the resistance of the loudspeaker Lsp that can be connected between the first and the second terminal A1, A2 of the output of the circuit arrangement.

This figure also shows a microphone MIC that generates the sensor signal Sanc. The sensor signal Sanc is fed to the second input E2 via a signal adaptation unit F. Furthermore, a plug connector S designed for connecting the first input E1 of the circuit arrangement to a source of the playback signal Spb is illustrated in this figure. Among other things, the source Q of the playback signal Spb has a resistance Rsrc.

The sensor signal Sanc recorded by the microphone MIC is fed to the second input E2 of the circuit arrangement. The sensor signal Sanc is inverted once in the first driver stage T1 of the compensating device Komp. The thusly obtained first noise signal Sanc1 is made available at the first summation node N1. In the second driver stage T2 of the compensating device Komp, the sensor signal Sanc is inverted once in the inverting amplifier OP and is subsequently inverted a second time in the inverting amplifier OP2. The thusly obtained second noise signal Sanc2 is made available at the first terminal A1 of the output of the circuit arrangement via the second summation node N2 and the coupling resistor Rspa and serves for the compensation of a current injected by the first driver stage T1 via the loudspeaker Lsp at the first input E1 of the circuit arrangement and/or at the first terminal A1 of the output of the circuit arrangement. Consequently, this node E1 or A1 features the virtual playback signal Ssp1. The superposition signal Ssp2 is obtained at the first summation node N1 in dependence on the first noise signal Sand and the playback signal Spb due to current summation at the resistors Rsm1, Rsm2 and Rsp. Consequently, the differential signal between the virtual playback signal Ssp1 and the superposition signal Ssp2 is made available between the first terminal A1 and the second terminal A2 of the output of the circuit arrangement.

The first and the second summation resistor Rsm2, Rsm2*a* are adapted to one another with respect to their scaling. A first voltage divider formed by the resistance Rsp of the connectable loudspeaker Lsp and the first scaling resistor Rsm1 is with respect to its scaling adapted to a second voltage divider formed by the second scaling resistor Rsm1*a* and the coupling resistor Rspa. Referred to the sensor signal Sanc, a current portion of the second noise signal Sanc2 is with respect to its value identical to a current portion of the superposition signal Ssp2 due to this scaling. Since these two current portions cancel out one another at the first terminal A1 of the output, a virtual zero point referred to the sensor signal Sanc results at the first terminal A1.

This advantageously causes a consistent mode of operation of the noise cancellation at any impedance of the playback source Q. This also applies to instances in which the playback source Q is disconnected or short-circuited.

A virtual zero point results for the voltage portions of the first and the second noise signal Sanc1, Sanc2 at the first terminal A1 of the output of the circuit arrangement. Due to this, the first terminal A1 is not modulated by the sensor signal Sanc or by the noise signals Sanc1, Sanc2 derived from this sensor signal. Since the playback signal Spb is coupled with the noise signal Sanc2 in a passive fashion at exactly this terminal A1, the impedance of the resistance Rsrc of the audio source Q advantageously has no effect on the function of the active noise cancellation.

In this case, the circuit of the operational amplifiers of the inverting amplifiers OP, OP1 and OP2 is realized in such a way that current compensation takes place at the first input E1, for example, with resistances R of respectively identical scaling.

FIG. 2 shows a second embodiment of a circuit arrangement according to the proposed principle. This exemplary embodiment corresponds to the exemplary embodiment in FIG. 1 with the following exceptions: an adaptation unit in the form of a third voltage divider Rin1, Rin2 referred to the reference potential terminal 10 is additionally provided. This third voltage divider makes available a common-mode signal Sin at the connecting point of the two resistors Rin1, Rin2, wherein said common-mode signal is fed to the non-inverting inputs of the inverting amplifiers OP1, OP2 of the first and the second driver stage T1, T2. The virtual playback signal Ssp1 is divided by means of this third voltage divider Rin1, Rin2 and is fed to the inverting amplifiers OP1, OP2 in the form of the common-mode signal Sin.

Due to this, the first and the second noise signal Sanc1, Sanc2 are respectively made available at the outputs of the inverting amplifiers OP1 and OP2 in such a way that no voltage drop referred to the playback signal Spb occurs at the respective summation resistor Rsm2, Rsm2*a*.

Consequently, no current from the driver stages T1, T2 is consumed with respect to the playback signal Spb. The playback volume is not affected by activating or deactivating the circuit arrangement. This advantageously minimizes the power consumption of the circuit arrangement for active noise cancellation.

In this case, the resistances of the third voltage divider Rin1, Rin2 are scaled as follows: the resistance Rin1 is scaled N-times as high as the resistance Rsp of the loudspeaker Lsp. The resistance Rin2 is scaled in accordance with the following formula:

$$Rin2=N\cdot Rsm1/G.$$

In this case, Rin2 represents the resistance Rin2, N corresponds to the factor N, Rsm1 corresponds to the first scaling resistor Rsm1 and G represents a factor G. The factor G corresponds to a respective amplification of the common-mode signal Sin in the first and the second driver stage T1, T2.

For example, if identical values are used for the input and feedback resistors of the operational amplifiers OP1, OP2 in the first and the second driver stage T1, T2, the value two results as amplification factor for G.

The factor N is chosen correspondingly high, for example in the range between 50 and 2000, in order to ensure that the third voltage divider Rin1, Rin2 does not cause a relevant reduction of the input impedance.

A factor M corresponds to a ratio between the resistance Rsp of the loudspeaker Lsp and the first scaling resistance Rsm1. The factor M is preferably chosen as high as possible, for example in the range between 3 and 30, such that only a slight portion of the playback level is lost at the first scaling resistor Rsm1. Another reason for this choice of the factor M is that, in case the operational amplifiers of the inverting amplifiers OP1, OP2 are not connected to a voltage supply, a diode clamp is created at the supply nodes by the output transistors of the inverting amplifiers OP1, OP2. If M is chosen correspondingly high, the voltage level at the nodes N1 and N2 remains below the diode voltage.

FIG. 3 shows a third exemplary embodiment of the circuit arrangement according to the proposed principle. The third exemplary embodiment corresponds to the second exemplary embodiment in FIG. 2 with the following exceptions: the resistors of the voltage divider of the second driver stage T2 are scaled K-times higher than the resistors of the voltage divider of the first driver stage T1. The coupling resistance Rspa, in particular, is scaled K-times higher than the resistance Rsp of the loudspeaker Lsp. The resistance of the second summation resistor Rsm2*a* is scaled K-times higher than the resistance of the first summation resistor Rsm2. The resistance of the second scaling resistor Rsm1*a* is scaled K-times higher than the resistance of the first scaling resistor Rsm1. The resistance of the inverting amplifier OP coupled to the second input E2 of the circuit arrangement is divided by the factor K. Consequently, the sensor signal Sanc is amplified by the factor K in the second driver stage T2.

Due to the multiplication of the resistance values, the current flowing through the second voltage divider Rsm1*a*, Rspa and the second summation resistor Rsm2*a* is divided by the factor K. This current therefore is significantly lower than the current of the virtual reproduction signal Ssp1 through the loudspeaker. The injection with a resistance that is increased by the factor K is compensated with the amplification by the factor K at the first inverting amplifier OP of the second driver stage T2. Consequently, a virtual zero point referred to the portion of the first and the second noise signal Sanc1, Sanc2 still results for the first output A1.

The summation resistors Rsm2, Rsm2*a* do not affect the input impedance of the circuit arrangement because no leakage current flows at the outputs of the inverting amplifiers OP1, OP2 in the activated mode. These outputs have a high resistance in the deactivated mode.

The factor K is specified such that the impedance at the first input E1 corresponds to the impedance of the loudspeaker Lsp. In this case, the following applies in accordance with the parallel circuit of the first and the second voltage divider:

$$RE1 = 1/1/(Rsp + Rsm1) + 1/(Rspa + Rsm1a).$$

In this formula, RE1 represents the impedance RE1 at the first input E1, Rsp represents the resistance Rsp of the loudspeaker Lsp, Rsm1 corresponds to the first scaling resistance Rsm1, Rspa corresponds to the coupling resistance Rspa and Rsm1*a* represents the first scaling resistance Rsm1*a*.

The factor M is adapted to the factor K in order to adapt the input impedance of the circuit arrangement to the impedance Rsp of the loudspeaker Lsp.

Since the amplifiers of the first and the second driver stage T1, T2 merely drive the current portion of the sensor signal Sanc, smaller designs than in an implementation based on active summation can be advantageously chosen for the operational amplifiers used in this case.

FIG. 4 shows a fourth exemplary embodiment of a circuit arrangement according to the proposed principle. This exemplary embodiment corresponds to the example in FIG. 3 with the following exceptions: the third voltage divider Rin1, Rin2 is scaled differently. An additional operational amplifier OP' is provided for making available the common-mode signal Sin and is coupled to the third voltage divider Rin1, Rin2. The common-mode signal Sin is fed to the inverting inputs of the inverting amplifiers OP1 and OP2. The scaling of the third voltage divider Rin1, Rin2 is realized as follows:

$$Rin1=N\cdot Rsp+Rsm1);$$

$$Rin2=N\cdot Rsm1.$$

In this formula, Rin1 represents the resistance Rin1, N corresponds to the factor N, Rsp represents the resistance Rsp of the loudspeaker Lsp, Rsm1 corresponds to the first scaling resistance Rsm1 and Rin2 represents the resistance Rin2.

In this embodiment, the non-inverting inputs of the inverting amplifiers OP1 and OP2 are advantageously connected to the reference potential terminal 10 such that the respective operational amplifiers do not have to follow a so-called common mode excursion. Since 1.5 V batteries are typically used for the power supply in noise cancellation systems, the common-mode range of the operational amplifiers is highly limited, but this has no noticeable negative effects in this case.

LIST OF REFERENCE SYMBOLS

E1, E2 Input
A1, A2 Terminal

Sanc1, Sanc2 Noise signal
Komp Compensating device
Lsp Loudspeaker
Ssp1 Virtual playback signal
Ssp2 Superposition signal
Spb Playback signal
Sanc Sensor signal
T1, T2 Driver stage
N1, N2 Summation node
OP, OP1, OP2 Inverting amplifier
Rsm2, Rsm2*a* Summation resistor
Rsm1, Rsm1*a* Scaling resistor
Rsp Resistance
Rspa Coupling resistor
Rin1, Rin2 Resistance
Sin Common-mode signal
MIC Microphone
S Plug connector
Rsrc, R Resistance
Q Source
F Signal adaptation unit

The invention claimed is:

1. A circuit arrangement for active noise cancellation, comprising:

a first input for supplying a playback signal;

a second input for supplying a sensor signal;

a first and a second terminal of an output that is designed for being connected to a loudspeaker; and a compensating device for respectively generating a first and a second noise signal as a function of the sensor signal, wherein the first and the second input are coupled to the first and the second terminal of the output by means of the compensating device in such a way that a virtual playback signal is provided at the first terminal of the output and a superposition signal is provided at the second terminal of the output such that a differential signal between the virtual playback signal and the superposition signal can be fed to the loudspeaker, and wherein a virtual zero point with respect to the sensor signal is formed at the first terminal of the output that is coupled to the first input of the circuit arrangement.

2. The circuit arrangement according to claim 1, wherein a portion of the second noise signal that is relevant to the sensor signal is with respect to its value adapted to a portion of the superposition signal that is relevant to the sensor signal and phase-inverted relative thereto.

3. The circuit arrangement according to claim 1, wherein the virtual playback signal is provided as a function of the second noise signal and the playback signal, and wherein the superposition signal is provided as a function of the first noise signal and the playback signal.

4. The circuit arrangement according to claim 1, wherein the compensating device comprises:

a first driver stage, the input of which is coupled to the second input of the circuit arrangement and the output of which forms a first summation node, at which the first noise signal is provided; and a second driver stage, the input of which is coupled to the second input and the output of which forms a second summation node, at which the second noise signal is provided, and wherein the first summation node is coupled to the second terminal of the output of the circuit arrangement, and the second summation node is coupled to the first terminal of the output of the circuit arrangement.

5. The circuit arrangement according to claim 4, wherein the first driver stage has an inverting amplifier that is connected to its input and a first summation resistor that is arranged downstream of said amplifier and is connected to the first summation node, wherein the second driver stage has a serial circuit that is connected to the input of the second driver stage and comprises two inverting amplifiers and a second summation resistor that is arranged downstream of said amplifiers and coupled to the second summation node, and wherein the first and the second summation resistors are adapted to one another.

6. The circuit arrangement according to claim 5, wherein a first scaling resistor referred to a reference potential terminal is connected to the first summation node in order to form a first voltage divider with a resistance of the connectable loudspeaker, and wherein a second voltage divider having a second scaling resistor referred to the reference potential terminal, as well as a coupling resistor connected to the first input of the circuit arrangement, is connected to the second summation node.

7. The circuit arrangement according to claim 6, wherein the first and the second voltage divider are dimensioned identically.

8. The circuit arrangement according to claim 6, wherein the second summation resistor and the second voltage divider respectively are scaled larger than the first summation resistor and the first voltage divider by a factor K and the sensor signal fed to the second driver stage is amplified by the factor K.

9. The circuit arrangement according to one of claims 4 to 8, furthermore comprising:

an adaptation unit that is coupled to the first input of the circuit arrangement that receives the virtual playback signal and is designed for providing a common-mode signal, wherein the common-mode signal is with respect to the level control of the inverting amplifiers of the first and the second driver stage realized in such a way that an output signal of a respective inverting amplifier is with respect to its voltage respectively adapted to a signal at the first and the second summation node.

10. The circuit arrangement according to claim 9, wherein the common-mode signal is respectively fed to a non-inverting input of the inverting amplifier of the first driver stage and to a non-inverting input of the inverting amplifier of the second driver stage that is coupled to the output of the second driver stage.

11. The circuit arrangement according to claim 9, wherein the adaptation unit has a third voltage divider referred to the reference potential terminal that with respect to its dimensioning is adapted to the first voltage divider with consideration of an amplification factor of the first and/or second driver stage.

12. A method for active noise cancellation, having the following steps:

supplying a playback signal;

supplying a sensor signal;

respectively generating a first and a second noise signal in dependence on the sensor signal;

generating a virtual playback signal in dependence on the second noise signal and the playback signal;

generating a superposition signal in dependence on the first noise signal and the playback signal; and providing a differential signal between the virtual playback signal and the superposition signal for a loudspeaker.

13. The method according to claim 12, wherein a portion of the second noise signal that is relevant to the sensor signal is with respect to its value adapted to a portion of the superposition signal that is relevant to the sensor signal and phase-inverted relative thereto.

14. The method according to claim 12 or 13, furthermore comprising the following step:

generating a common-mode signal in dependence on the virtual playback signal, wherein the first and the second noise signal respectively are also generated in dependence on the common-mode signal.

* * * * *